United States Patent [19]

Caldwell et al.

[11] Patent Number: 4,483,084

[45] Date of Patent: Nov. 20, 1984

[54] TRENCHER

[75] Inventors: Robert H. Caldwell; Randy J. Scott, both of Jacksonville, Ill.

[73] Assignee: Grizzly Corporations, Jacksonville, Ill.

[21] Appl. No.: 386,694

[22] Filed: Jun. 9, 1982

[51] Int. Cl.[3] ..... E02F 5/06

[52] U.S. Cl. ..... 37/86; 37/DIG. 17

[58] Field of Search ..... 37/86, 84, 85, 191 A, 37/192 A, DIG. 17

[56] References Cited

U.S. PATENT DOCUMENTS

| | | | |
|---|---|---|---|
| 1,769,074 | 7/1930 | Ruatti | 37/86 |
| 2,748,504 | 6/1956 | McIninch | 37/86 |
| 2,749,756 | 6/1956 | George | 37/86 |
| 2,783,556 | 3/1957 | Burns et al. | 37/DIG. 17 |
| 3,695,716 | 10/1972 | Meyer | 37/DIG. 17 |
| 3,834,049 | 9/1974 | Bond | 37/DIG. 17 |
| 3,932,951 | 1/1976 | Scott et al. | 37/86 |

FOREIGN PATENT DOCUMENTS

| | | | |
|---|---|---|---|
| 1181891 | 6/1959 | France | 37/86 |

*Primary Examiner*—Edgar S. Burr
*Assistant Examiner*—Moshe I. Cohen
*Attorney, Agent, or Firm*—Wm. A. Snow

[57] ABSTRACT

A trencher machine for attachment to a tractor movably mounted hydraulically for up and down movement relative thereto, boom means for adjusting the depth of the cut in the soil, boom means pivotally mounted on a support means including cutting means thereon.

10 Claims, 8 Drawing Figures

TRENCHER

SUMMARY OF THE INVENTION

A trencher having a new attachment concept for attachment to a tractor, the tractor having a hydraulic system and a 540 r.p.m. takeoff, the trencher having a main frame to which is attached a pivotal boom containing a drive and driven sprocket for an endless chain having cutters to do the cutting thereon, a power takeoff shaft connected to the tractor output shaft for driving a head shaft which, in turn, drives the drive sprocket and also acts as a pivoting axle for the trencher boom and the crumber, the trencher having a creep drive for producing a slow forward movement pushing the tractor forward and hydraulic means including an adjustable flow regulator valve for operating a low speed hydraulic motor for creeping drive, and a 3-position directional control valve to shift the boom and crumber to operative and non-operative position.

BRIEF DESCRIPTION OF THE DRAWINGS

FIG. 6 is an expanded perspective view;

DETAILED DESCRIPTION OF THE INVENTION

Figure 1:
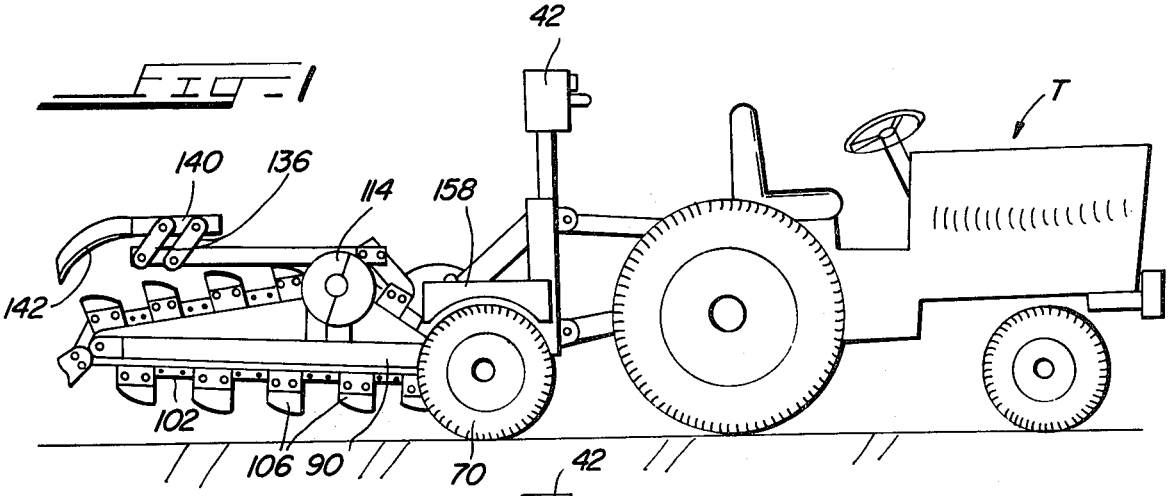
FIG. 1 is a side view of the present invention.
Figure 2:
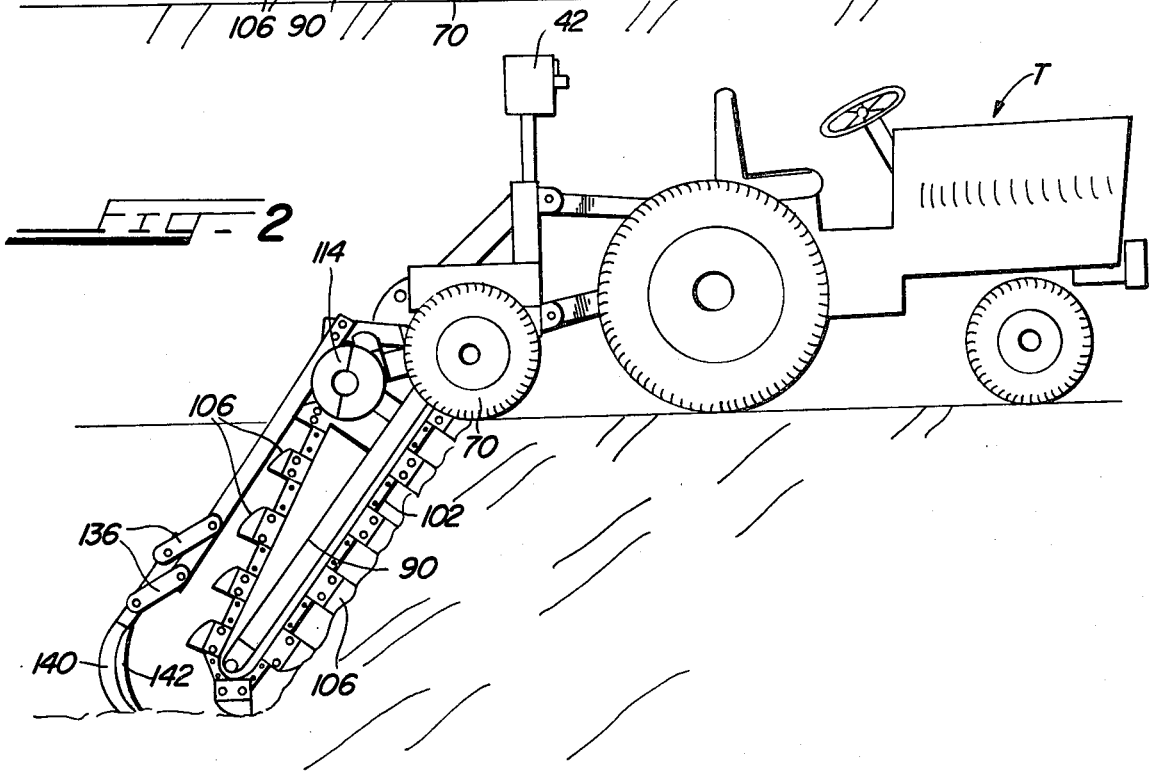
FIG. 2 is a side view with the trencher in digging position.

The present invention requires a tractor "T" having a three-point hitch, a minimal hydraulic system, and a 540 r.p.m. power takeoff 24.

The trencher is made up of two basic parts, namely a creep drive and digging mechanism.

The trencher main frame 26 has an upper leg 28, lower leg 30 and rearwardly extending legs 32, 33, a diagonal brace leg 34, and vertical side legs or frames 38, 40.

Extending above the upper leg 28 is an adjustable hydraulic flow regulator 180 and a "tilt" valve 72 in housing 42 supported by a vertical bar 44, the lower end being bolted to the upper leg 28 medially thereof. Also mounted to and lying in back of the upper leg 28 is a hydraulic creep motor 46.

Self-aligning pillow block bearings 48, 50 are bolted each to one of the rear upper surfaces of the lower legs 32, 33 to support a shaft 52 therebetween. A drive sprocket 54 is secured to the shaft medially of its ends.

The power takeoff 24 from the tractor "T" is connected to the telescoping drive shaft 56 through a torque limiter 146 and universal gears 148 to speed reducing gears in gear box 58. The output shaft 57 contains sprocket 55 which is attached by chain 59 to a sprocket 107 mounted to the head shaft 52 to provide power to the drive sprocket 54.

The hydraulic oil is channeled to the flow regulator by hose 45. The flow regulator 180 routes oil through hoses 64, 65 to the creep motor 46 (hereinafter detailed). The creep motor's output shaft is connected through a series of speed reducing sprockets and chains generally indicated by the numeral 66 to the axle 68 of the trencher on which wheeled tires 70 are secured one to each end thereof. Only one is shown in the drawing but the opposite tire should be understood.

By adjusting the oil flow from the regulator 180 in housing 42 (see FIG. 4) to the motor 46, with the transmission of the tractor in neutral, the oil from the regulator 180 to the creep motor 46 will cause the wheels 70 to rotate, pushing the tractor forward ahead of the trencher via sprockets 80, 82, 55, 86, with the sprockets 80, 82 mounted on shaft 88 and the sprocket 86 mounted on the all 68. By regulating the amount of oil from the regulator 180 to the motor 46, this determines the amount of speed or forward movement of the tractor, as will hereinafter be described.

Figure 4:
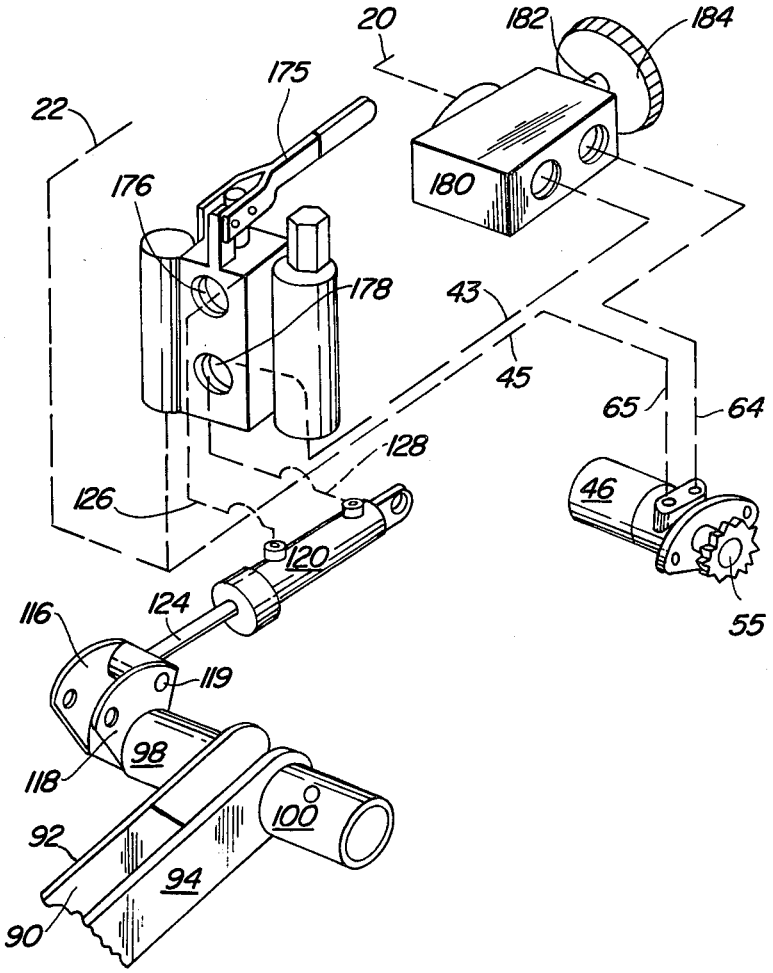
FIG. 4 is a perspective view of the hydraulic system.
Figures 5, 8:
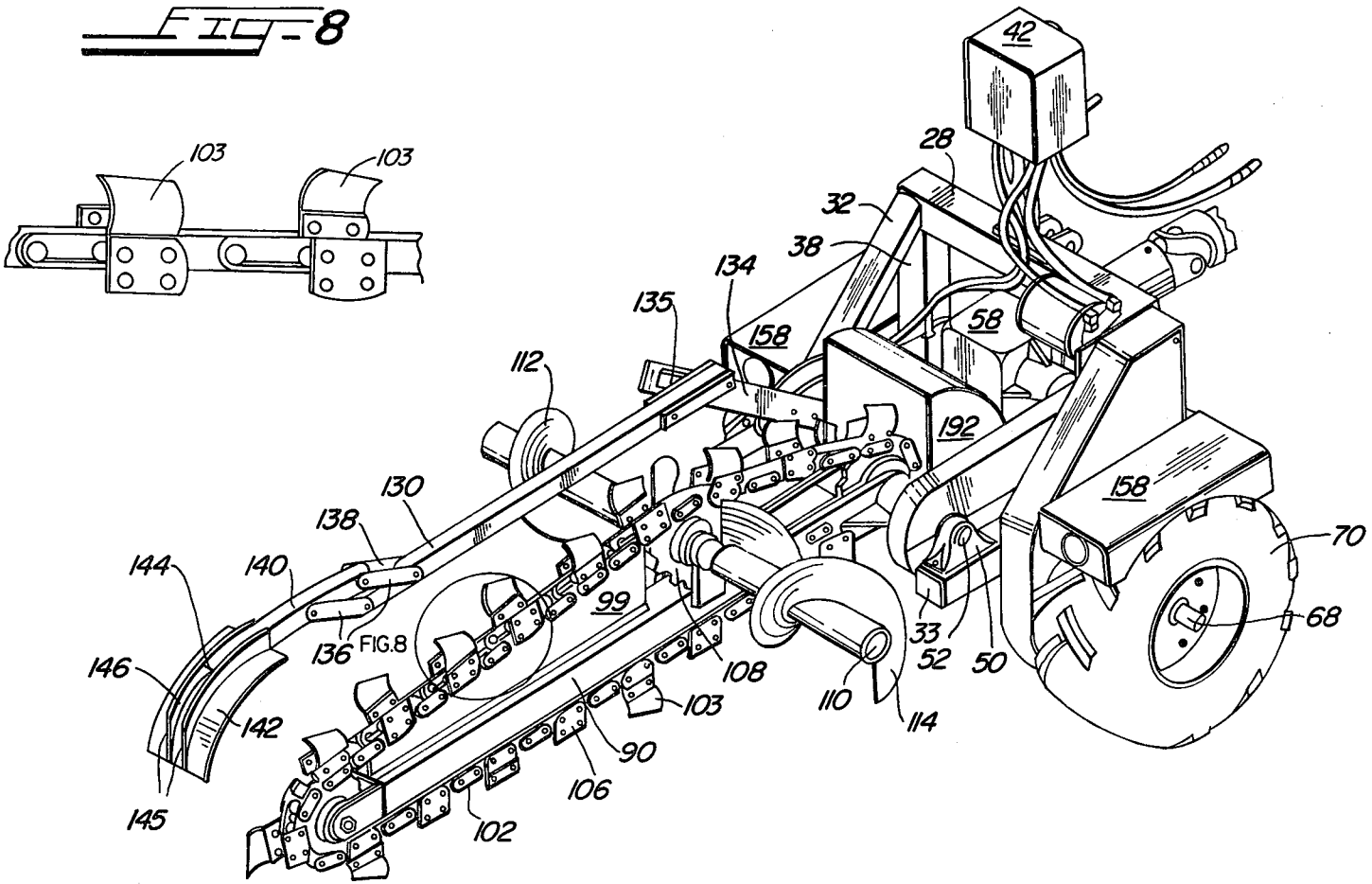
FIG. 5 is a perspective view of the trencher.
FIG. 8 is a plan view taken in the circle of FIG. 5.
Figure 9:
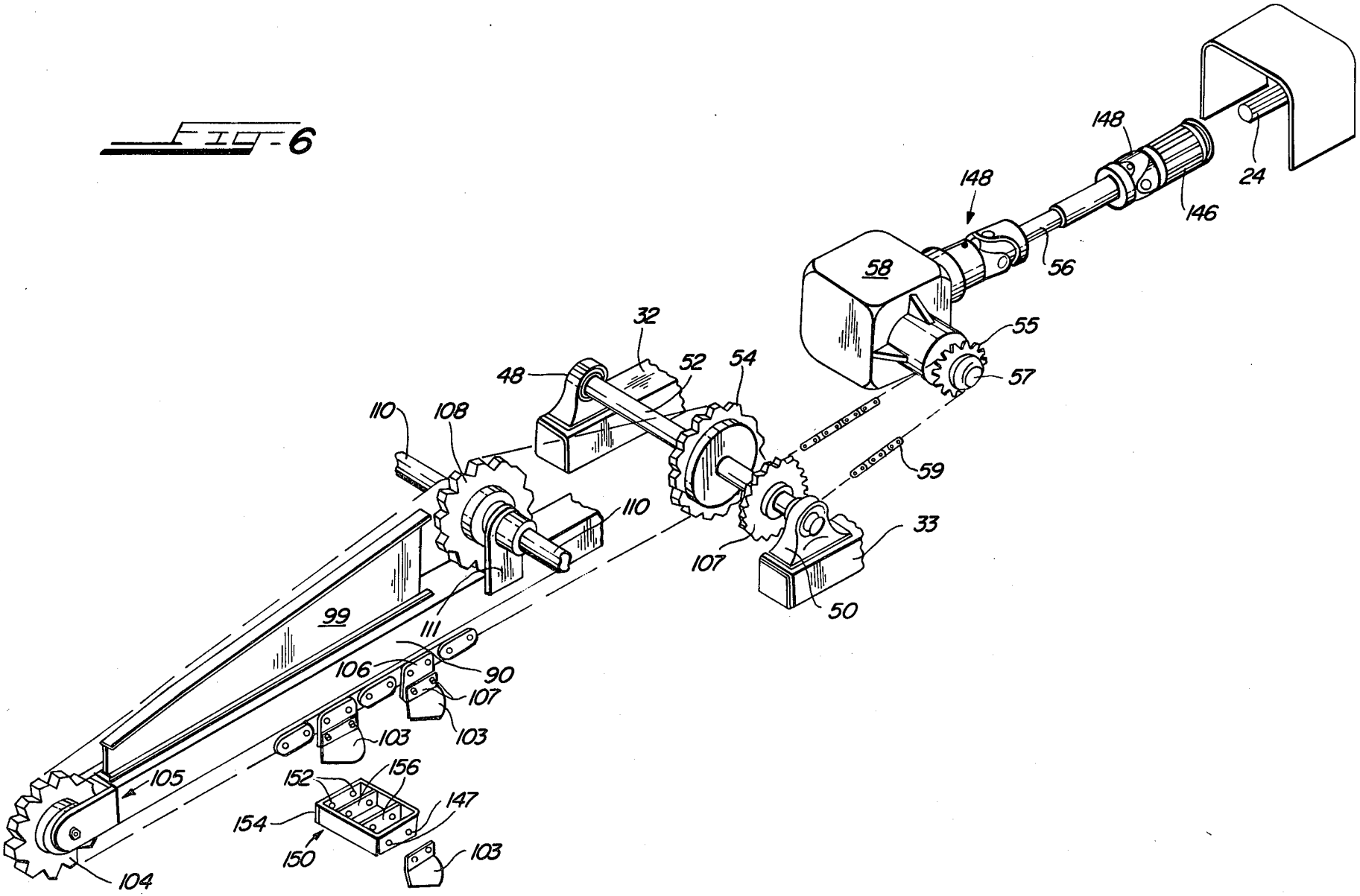
Figure 7:
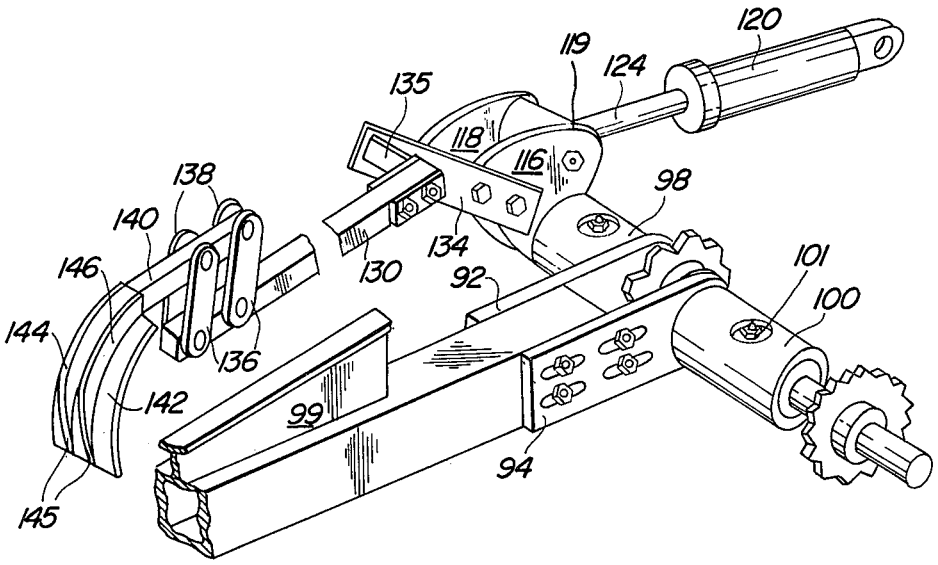
FIG. 7 is a perspective view showing how the boom is anchored and the boom is to be tilted up or down.

A boom 90 is secured to the head shaft 52 through a pair of plates 92, 94 by four bolts 96 extending through aligned slots 97. The rear ends of the plates 92, 94 are provided with right angled plates 94''. Spaced therefrom are a pair of right angled plates 94'' anchored to the boom 90 having a threaded aperture to receive bolts 92'. When the bolts 96 are loosened, the bolt 92' may shift the boom to adjust the endless chain 102. A pair of elongated, V-like shaped plates 90'', 96' lying longitudinally are welded one to each side of the plates 92, 94 and to the boom mounts 98, 100. The boom mounts 98, 100 are hollow cylinders with appropriate bushings and seals and are secured to the head shaft 52. Apertures in boom mounts 98, 100 are provided with appropriate grease fittings 101'. One end of each of the plates 92, 94 is welded to the inner end of the boom mounts 98, 100, as seen in the drawing (FIG. 4).

An endless chain 102 is placed on the drive sprocket 54 and extends to the rear and is mounted on the idler sprocket 104. A series of cutter blades 103 are removably mounted on the endless chain by bolts 107 and depend from plates 106. The idler sprocket 104 is mounted on an axle between the plates of a longitudinally extending, U-shaped bracket 105 with appropriate bearings. The connector plate abuts the end of boom 90 and is welded thereto.

An auger sprocket 108 is mounted rearwardly of the drive sprocket 54 with appropriate bearings and is pinned to shaft 110 and supported by spaced plates 111 anchored at their lower ends to boom 90 by welding. An I-beam 99 is welded medially to the upper surface of the boom 90 and medially of the sides thereof. The chain 102 rides on the upper surface of the I-beam 99 to support it above the boom. The I-beam 99 extends rearwardly at an angle.

A pair of auger flights 112, 114 are mounted on the shaft 110 so that the earth removed by the cutter blades will be shifted sideways of the trench.

Figure 3:
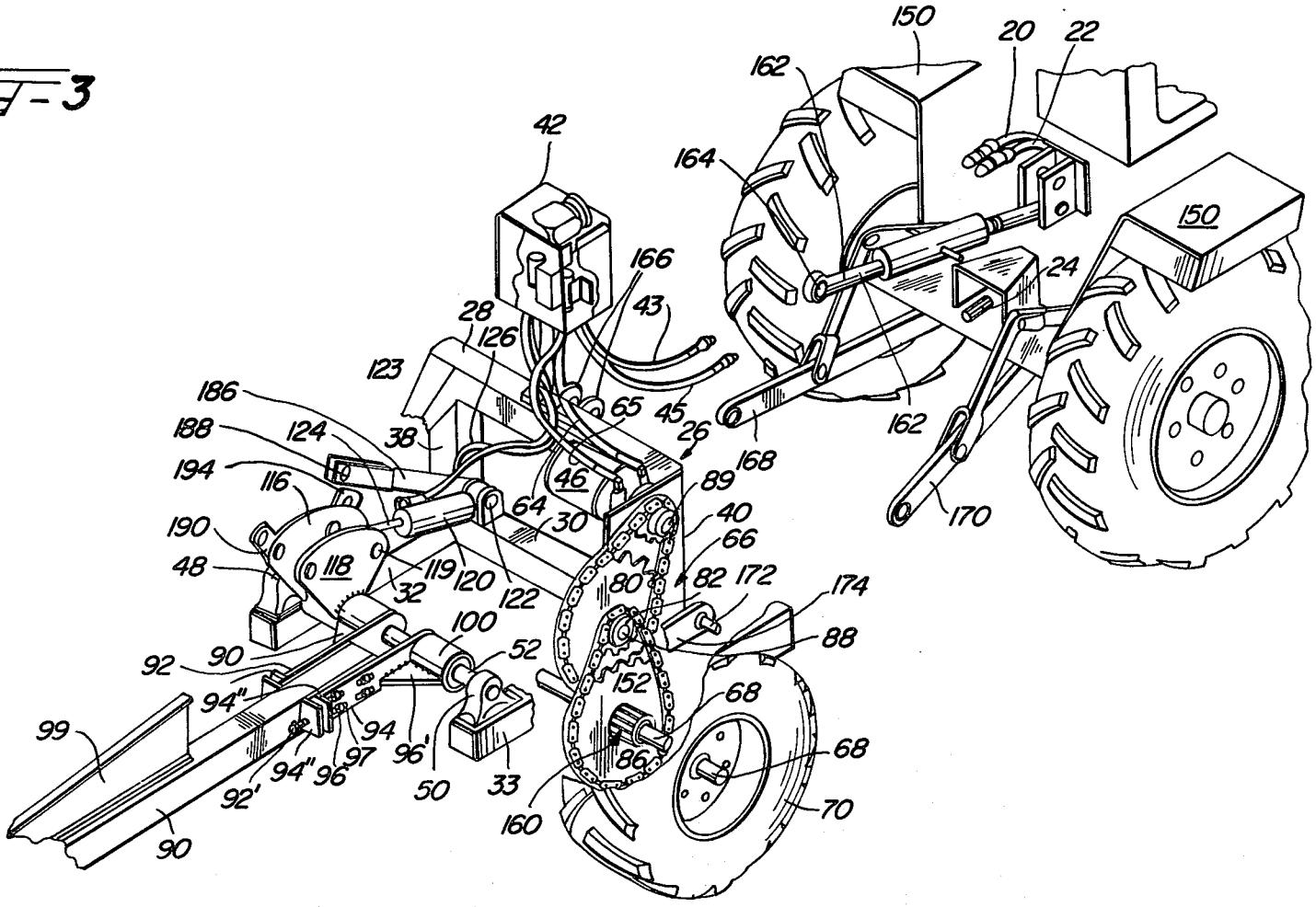
FIG. 3 is a perspective view with parts broken away.

A pair of V-like plates 116, 118 are spacedly mounted on boom mount 98 by welding at its inverted apex with the upper end extending upwardly and provided with a radius. (See FIG. 3.)

A tilt cylinder 120 is pivotally mounted to shaft 122 supported between a pair of upstanding spaced plates mounted on the frame lower leg 30. The free end of the cylinder rod 124 is pivotally mounted between plates 116, 118 by a pin 119. The tilt cylinder is operable by the hydraulic fluid flowing from the tilt valve 72 in housing 42 through hoses 126, 128 to lower or raise the boom 90. The boom may be drawn to vertical position above the shaft 52 based solely on the operation of the tilt valve 72.

The crumber is comprised of a steel beam 130, square in cross-section, positioned above the boom 90 and extending rearwardly thereof. One end is mounted to the plate 118 through an angularly extending bar 134. The bar 134 is bolted at one end to the plate 118 and at the other end welded to a short, horizontal, square bar 135 at right angles and anchored to the front end of the crumber bar 130. Now the bar 130 lies directly over the boom 90. The rear end of the elongated bar 130 has pairs of short plates 136, 138, respectively, pivotally anchored thereto. The other end of the pairs of plates 136, 138 is pivotally anchored to one end of a downwardly extending, square in cross-section bar 140 for a parallelogram action. A curved plate 142 is provided with a pair of spaced, upwardly-extending plates 144, 146', the lower ends of which are welded to the plate 142. The free end of bar 140 is welded between the plates 144, 146' at the forward end thereof. The plates 144, 146 are tapered at their rear ends as at 145. The crumber plate 142 drags along the bottom of the trench dug by the cutter blades 103 on the endless chain 102 to drag forward the loose spoils.

With reference to the attachment of the trencher to the tractor, the trencher attachment is provided with a commercially available spring-loaded Scheid pre-set slip-clutch type radial pin torque limiter 146 and two universal joints 148 connected with the telescopic drive shaft 56 therebetween which is connected at its rear end to the reducing gears in box 58 as aforesaid.

The bolts 96 in slots 97 are for use in adjusting the boom to adjust the chain 102 on the boom and on the upper surface of the I-beam 99 on which it rides between sprockets 54, 108 and 104.

In order to dig a trench wider than six inches, an attachment 150 (FIG. 6) is provided. The bolts 107 are removed from chain plate 106 and the attachment 150 is bolted thereto through the apertures 152 to the lower end of plate 106 and the cutter blades 103 secured by bolts in the apertures 147 to dig a trench eight to twelve inches wide dependent upon the width of the attachment 150. The maximum depth of the trench may be from three feet to six feet depending on the length of the boom selected.

Appropriate mud guards 158 are placed over the tires 70.

When the transmission on the tractor is engaged, an over-running clutch 160 on the trencher axle 68 allows the wheels 70, and the axle 68 to free wheel, thus not turning the reduction sprockets 66.

The three-point attachment comprising the upper rod 162 which has an eye 164 is placed between the arms 166 and bolted. The two side arms 168, 170 are placed on the rods 172 mounted on the side frames 38, 40 through a short plate 174. Due to the complexity of the drawings, only one rod and arm are shown but those not shown are mounted to the side frame 38 in the same manner as rod 172 and arm 174.

When the tractor is in neutral and the PTO shaft is signaled, the head shaft 52 rotates, thereby running the digging chain without affecting the position of the boom or the boom mounts.

To raise the trencher boom 90, the tilt valve port 176 is opened by shifting the handle 175 upwardly to direct the hydraulic fluid to the cylinder 120.

The creep motor 46 is made operable by the hydraulic fluid from the tractor moving through hose 45 to the adjustable flow control 180 through hose 64, to generate power in the creep motor 46, with the excess hydraulic fluid returning to the tractor tank through hose 65 and hoses 43, 22. The adjustment is controlled by a valve screw 182 through handle 184.

When the tractor transmission is in neutral, the creep motor 46 will push the tractor forwardly and pull the trencher forward simultaneously through the gearing heretofore mentioned.

The trencher may be anchored in vertical position by an angularly-extending bar 186 anchored at its lower end to the side leg 38. The bar has a pair of spaced plates 188 anchored one to each side of the upper end of the bar to receive the plate 190 therebetween. The plates 188 and 190 have aligned apertures therein to receive a bolt (not shown).

If the boom is to be kept in a horizontal position, and to relieve the hydraulic system, the plates 188 may be positioned over the upstanding plate 194 on plate 116. The plates 188 and plate 194 have aligned apertures therein and are bolted together. To prevent spoils which may adhere to the blades from flying forward, a protective arcuate shield 192 is provided.

Although but one specific embodiment of this invention is herein shown and described, it will be understood that details of the construction shown may be altered or omitted without departing from the spirit of the invention as defined by the following claims.

We claim:

1. A trenching attachment for mounting on a wheeled tractor having an engine, a power take-off and a hydraulic system which are both driven by the engine, and a three-point hitch, said attachment comprising a frame with two spaced wheels, connecting means on the attachment for readily connecting and disconnecting the attachment to the three-point hitch, power take-off, and hydraulic system of any standard tractor, means on the attachment connected to the power take-off of the tractor for limiting torque when the attachment encounters an obstacle or overload conditions, a boom pivotally mounted on the frame which supports an endless digging chain mounted thereon, the chain having blades and being driven by the power take-off of the tractor to which it is mechanically connected, hydraulic control means connected to and obtaining its power from the hydraulic system of the tractor through tractor connecting hydraulic output lines, first hydraulic drive means hydraulically connected to the hydraulic control means and mechanically connected to the trencher wheels for providing the sole power for the rate of forward ground advancement for both the tractor and trenching attachment independently of tractor engine speed, and second hydraulic drive means connected hydraulically to the hydraulic control means and mechanically connected at its output to the boom for independently controlling the elevation of the boom.

2. The trenching attachment as set forth in claim 1, including connecting means positioned adjacent each of the two spaced wheels to engage the three-point hitch, and hydraulic lines connected to the hydraulic control means having a quick disconnect element for attachment to the hydraulic output lines of the tractor.

3. The trenching attachment as set forth in claim 1, wherein, the boom has boom locking means directly connected thereto, and to the frame, for providing mechanical locking of the boom in an upright position independently of the second hydraulic drive means.

4. The trenching attachment as set forth in claim 1, wherein, an auger is attached to the frame and behind the trencher wheels which extends transversely to the boom, and is connected to the endless chain which provides rotational movement therefor, and a protective arcuate shield disposed about the end of the boom adjacent the pivoted connection of the boom to preclude spoils from the blades flying forward.

5. The trenching attachment as set forth in claim 1, wherein, the means for limiting torque includes a mechanical assembly which provides for both release from and automatic mechanical non-slip reengagement to the power take-off.

6. The trenching attachment as set forth in claim 5, wherein, the mechanical assembly which provides for release and automatic reengagement includes a slip clutch mounted on the frame and directly engaging an output spline of the power takeoff unit of the tractor.

7. The trenching attachment as set forth in claim 1, wherein, the hydraulic control means includes an hydraulic flow regulator having two separate control levers and corresponding hydraulic circuits for respectively independently controlling hydraulic flow to the first and second hydraulic drive means.

8. The trenching attachment as set forth in claim 7, wherein, the first hydraulic drive means includes an hydraulic motor connected to the flow requlator, and an intermediate gear reduction assembly mechanically connected to the output of the hydraulic motor and having its mechanical output mechanically connected to the trenching attachment wheels.

9. The trenching attachment as set forth in claim 8, wherein, the output of the gear reduction assembly is connected to a chain and sprocket drive which is connected to and mechanically transmits mechanical movement to the drive wheels.

10. The trenching attachment as set forth in claim 9, including an over-running clutch in the sprocket drive assembly which is connected to the trencher wheels to permit them to move freely without transmitting rotational motion through the sprocket assembly when the tractor moves forward at a greater speed than that provided through the trencher wheels.

* * * * *